US007665335B2

(12) United States Patent
Stuckey

(10) Patent No.: US 7,665,335 B2
(45) Date of Patent: Feb. 23, 2010

(54) HANDLE ASSEMBLY

(75) Inventor: David Martin Stuckey, Thomastown (AU)

(73) Assignee: Burgundy Trial Pty Ltd, Victoria (AU)

( * ) Notice: Subject to any disclaimer, the term of this patent is extended or adjusted under 35 U.S.C. 154(b) by 0 days.

(21) Appl. No.: 11/571,522

(22) PCT Filed: Jul. 8, 2005

(86) PCT No.: PCT/AU2005/000999

§ 371 (c)(1),
(2), (4) Date: Dec. 31, 2006

(87) PCT Pub. No.: WO2006/005109

PCT Pub. Date: Jan. 19, 2006

(65) Prior Publication Data

US 2008/0047308 A1 Feb. 28, 2008

(30) Foreign Application Priority Data

Jul. 8, 2004 (AU) ..... 2004903770
Aug. 13, 2004 (AU) ..... 2004904608

(51) Int. Cl.
*E05B 13/10* (2006.01)

(52) U.S. Cl. ..... 70/208; 70/210; 70/215; 70/422; 292/336.3; 292/347; 292/DIG. 31

(58) Field of Classification Search ..... 70/208, 70/210, 215, 1.5, 416, 417, 422, 224; 292/336.3, 292/347, DIG. 31
See application file for complete search history.

(56) References Cited

U.S. PATENT DOCUMENTS

| | | | | | |
|---|---|---|---|---|---|
| 5,347,834 | A * | 9/1994 | Ramsauer | ..... | 70/120 |
| 5,454,239 | A * | 10/1995 | Esaki et al. | ..... | 70/208 |
| 5,586,459 | A * | 12/1996 | Bullock et al. | ..... | 70/224 |
| 6,039,363 | A * | 3/2000 | Sugimura et al. | ..... | 292/202 |
| 6,053,018 | A * | 4/2000 | Ramsauer | ..... | 70/208 |
| 6,490,896 | B2 * | 12/2002 | Segawa | ..... | 70/208 |
| 6,668,603 | B2 * | 12/2003 | Segawa | ..... | 70/208 |
| 7,269,984 | B2 * | 9/2007 | Jackson | ..... | 70/210 |
| 2002/0184930 | A1 * | 12/2002 | Segawa | ..... | 70/208 |
| 2003/0150246 | A1 * | 8/2003 | Gladden et al. | ..... | 70/208 |
| 2004/0089035 | A1 * | 5/2004 | Ciezki et al. | ..... | 70/208 |

* cited by examiner

*Primary Examiner*—Lloyd A Gall
(74) *Attorney, Agent, or Firm*—Venable, Campillo, Logan & Meaney PC

(57) ABSTRACT

A swing handle assembly (10) comprising a lockable handle member (20) which when pivotally swung into co-operable alignment with a frame (30) enables the assembly (10) to be placed in a locked condition, wherein the end of the handle member distal from the pivotally attached end comprises a substantially deformable housing (60) located therebeneath, the housing (60) being adapted to support a lock actuator (44), whereby when the assembly is locked and when a destructive outside force sufficient to cause deformation of the housing (60) the locked condition of the assembly (10) is substantially maintained.

14 Claims, 4 Drawing Sheets

HANDLE ASSEMBLY

FIELD OF THE INVENTION

The invention generally relates to a swing handle assembly which is particularly useful as handle hardware on metal enclosures. The metal enclosures may include doors to storage areas and boxes, electrical switch-gear cabinets or other high security applications. In particular, the invention relates to a swing handle assembly for use in high security locking applications. It will be convenient to hereinafter describe the invention in relation to these particular applications. It should be appreciated however that the present invention is not limited to these applications only.

BACKGROUND TO THE INVENTION

Barriers or doors for entry and exit from metal enclosures, which are used as storage areas, necessarily require a handle with an internal latch or locking mechanism for security and safety. These handle and locking mechanisms, being most conveniently operable by means of a key, primarily function to provide a means of preventing unauthorised personnel from entering the otherwise secured locked enclosure.

Commonly employed door assemblies may contain the or part of a locking means comprising a barrel and lock means carried by the handle. However, a problem associated with prior assemblies is that the locking means contained therein can easily be tampered with by vandals trying to smash and destroy the locking means to render it inoperable and thus then gain easy access to the otherwise secure enclosure. In order to overcome this problem, a high security locking means needs to be employed with the handle assembly. However, it has subsequently been found that such high security locking means could not be satisfactorily accommodated and yet still function as required within existing handles. It was discovered that sometimes the high security locking means inadvertently protruded from the upper surface of the handle, thereby exposing the locking means as a target for vandals to destroy.

It is therefore a preferred object of the present invention to provide a handle assembly which is better able to maintain the integrity of the locked assembly even if the locking means is rendered inoperable. It is a further preferred object to provide an assembly which can both accommodate a high security locking means and at the same time make the handle assembly more secure by making the locking mechanism substantially tamper-proof. It is a further object of the present invention to overcome, or at least substantially ameliorate, at least some of the disadvantages and shortcomings of the prior art.

SUMMARY OF THE INVENTION

According to one aspect of the present invention, there is provided a swing handle assembly comprising a lockable handle member which when pivotally swung into cooperable alignment with a frame enables the assembly to be placed in a locked condition, wherein the end of the handle member distal from the pivotally attached end comprises a substantially deformable housing located therebeneath, the housing being adapted to at least partially support a locking means when located therein, whereby when the assembly is locked and the locking means is subjected to a destructive outside force sufficient to cause deformation of the housing, the locked condition of the assembly is substantially maintained.

Preferably, the locking means when located is substantially supported by the housing, which housing is positioned on the handle member distal from its pivotal attachment end. The frame preferably contains a chamber into which the housing and its supported locking means are receivable. Actuation of the locking means, which preferably co-acts with the frame, enables the handle member to be placed either in a locked or an unlocked condition relative to the frame.

The frame is a substantially open-box member comprising a substantially rectangular-shaped base section having substantially oblique-shaped upwardly extending outer walls, wherein the outer walls terminate in a first opening which provides an entry to the interior of the frame. The base section contains a second opening therein leading to a chamber or well which is either formed substantially integral with the base section or is locatable under and aligned with the second opening, wherein the chamber is adapted to substantially receive the housing. When so installed, the locking means can be operated to lock or unlock the handle member relative to the frame. Further openings may be provided in the base section to permit fixing of the frame to the device that will carry the assembly or to receive therein a lock-actuating means, for example, a shaft upon or to which one end of the handle member may be attached.

The handle member is preferably of a substantially complimentary shape to the opening of the frame to allow the handle member to be able to substantially sit or be substantially accommodated within that opening. The handle member is more preferably of an open box-like body configuration having a substantially obround shape comprising an upper wall having opposed end walls extending therefrom, opposed side walls and a partially open underside wherein the underside contains edges on or even within which a spacer means is adapted to engage. The pivotally attached end of the handle member is preferably in the form of a ball joint, which enables the handle member to pivot relative to the frame. The ball joint preferably co-operates with a lock-actuating shaft that is received within the frame via a second opening in the base section of the frame. The end of the handle member distal from the attached end is able to be raised and rotated relative to the attached end of the handle member. To the unattached end of the handle member, there is provided a lifting means either additional to or integral with this end. When the handle member is sitting within the opening of the frame, the lifting means preferably extends beyond the opening and as such permits a user access to the lifting means. Raising the lifting means causes the handle member to be lifted out of the opening and permits it to be moved or rotated. Preferably, the lifting means is formed such that it is of reduced thickness relative to the remainder of the handle member. It would preferably be designed such that if it is acted upon with force (which would be required if the assembly is in the locked condition), it will shear off rather than cause the locking means to fail or be destroyed. The ball joint of the handle member, preferably pivotally co-acting with the lock-actuating shaft, is retained in position by fastening means on the underside of the frame.

The locking means can be of any typical type as known and used in the art. In a preferred aspect, the locking means is of a barrel type comprising a cylinder or barrel with a locking bolt end and a key arrangement with a key-receiving end, wherein the locking bolt end contains a lock actuator to directly or indirectly engage the frame for locking the handle member to the frame, thereby placing the assembly in a locked condition.

When the locking means is installed in the housing of the handle member, the key-receiving end thereof is preferably substantially flush-mounted with an upper face of the handle member. It is preferable that any raised section is formed integral with the upper face of the handle member and of the same material as the remainder of the assembly. Preferably, the raised portion is included in the profile when moulding the upper wall or face when the handle member is manufactured. Alternatively, the raised section could be constructed separately and of a different material and is inserted into the upper face of the handle member during manufacture thereof. The upper and exposed face of the handle member is most preferably formed with a raised section to surround and therefore protect the key-receiving means in the event of an intruder attack.

The key-receiving end is preferably fitted with a lock cylinder for moving the locking means from an unlocked to a locked condition, wherein a key inserted into the lock cylinder actuates the lock actuator. When the handle member is in the closed or locked condition, it is lockable by operation of the key means and once unlocked, the handle member is pivotally movable from the closed to the open position.

The housing is preferably a substantially obround member having a box-like body comprising a lower wall having substantially upwardly side walls and opposed end walls extending therefrom, which end walls are of a substantially semi-circular configuration, wherein the lower wall or one or both of the side wall(s) is/are provided with cut-out region(s) which act to expose the lock actuator to enable the lock actuator to move between a locked and an unlocked position. More preferably, one of the opposed end walls is chamfered relative to the other opposed end wall to facilitate receipt or removal of the housing relative to the second opening of the frame.

When the locking means is supported in the housing and is subjected to a destructive outside force, the force causes the locking means to deform and/or substantially fracture the lower wall and/or one or both side wall(s) of the housing such that resultant pieces from the lower wall and or one or both side wall(s) can preferably act to substantially prevent the assembly from being placed in the unlocked condition.

The provision of the housing therefore not only offers support for and correct alignment of the locking means relative to the opening in the base section of the frame, but it also provides added protection to the handle assembly. Should an intruder attempt to break open the handle assembly by trying to smash the assembly, the housing acts to substantially prevent the locking means from being able to be placed in an unlocked position and as such it can hold the locking means in place relative to the handle member. Should however the intruder succeed in fracturing the housing, the resulting debris from the broken or shattered housing made up of the lower wall, opposed end walls and/or side walls can fill the available space surrounding the lock actuator, such that the actuator is unable to rotate and thus remains in locked contact with the frame.

In a further aspect of the invention, there is also provided a spacer means for use with any handle assembly and preferably, the handle assembly of the invention being substantially attachable to or integral with a handle member, the spacer means being able to substantially engage with or sit on the handle member, wherein the spacer means acts to hold the handle member above or out of contact with an area surrounding the assembly. Preferably, the spacer means is of a substantially T-shaped configuration having a stem and cross-piece, wherein the stem piece is able to be substantially retained within the handle member, while the cross-piece is able to substantially engage with or sit on the underside region of the handle member. In this way, scratching of and damage of this area can be significantly reduced.

Each part of the handle assembly is preferably manufactured from any suitable material known in the art. The choice of material used for each component of the assembly will be dictated by the environment in which the handle is to be used. For example, if the handle is to be used in a potentially water-corrosive environment, the make-up or composition of each of the parts would be duly selected upon the extent of its potential exposure to the environment i.e. on a freezer delivery van, the material selected would be stainless steel. The handle may also appropriately be coated with a suitable plastics material to prevent damage to a hand being placed upon a handle attached to an enclosure kept at reduced temperature. The housing may be made of the same or different material to the remainder of the assembly. The lower wall and/or one or both of the side walls or one or both of the end wall(s) of the housing may be made of a different material to the material used for the remainder of the housing or the walls of the housing may be comprised of segments in order to facilitate the fracturing thereof and should the locking means be subjected to an outside force, it is preferable that the resultant pieces of debris produced thereby be able to surround and block the lock actuator preventing it from being placed in an unlocked condition. The spacer means may be manufactured integral with the handle member and a layer of suitable plastic material placed over the surface contacting with the side wall of the opening of the frame or alternatively, the spacer means may be manufactured entirely from a suitable plastics material and attached to the underside of the handle member by an appropriate fastening means. Preferably, the spacer means is manufactured from polypropylene and screw-mounted onto the handle member as close as possible to the ball joint thereof.

The scope of the invention further extends to the installation and use of the handle assembly of the invention as handle hardware on metal enclosures. Such metal enclosures include doors, storage areas, electrical switch-gear cabinets or other high-security applications.

DESCRIPTION OF THE DRAWINGS

Other features and advantages of one or more preferred embodiments of the present invention will be readily apparent to one of ordinary skill in the art from the following written description with reference to, and used in conjunction with, the accompanying drawings, in which.

DETAILED DESCRIPTION OF THE PREFERRED EMBODIMENT

Figure 1:
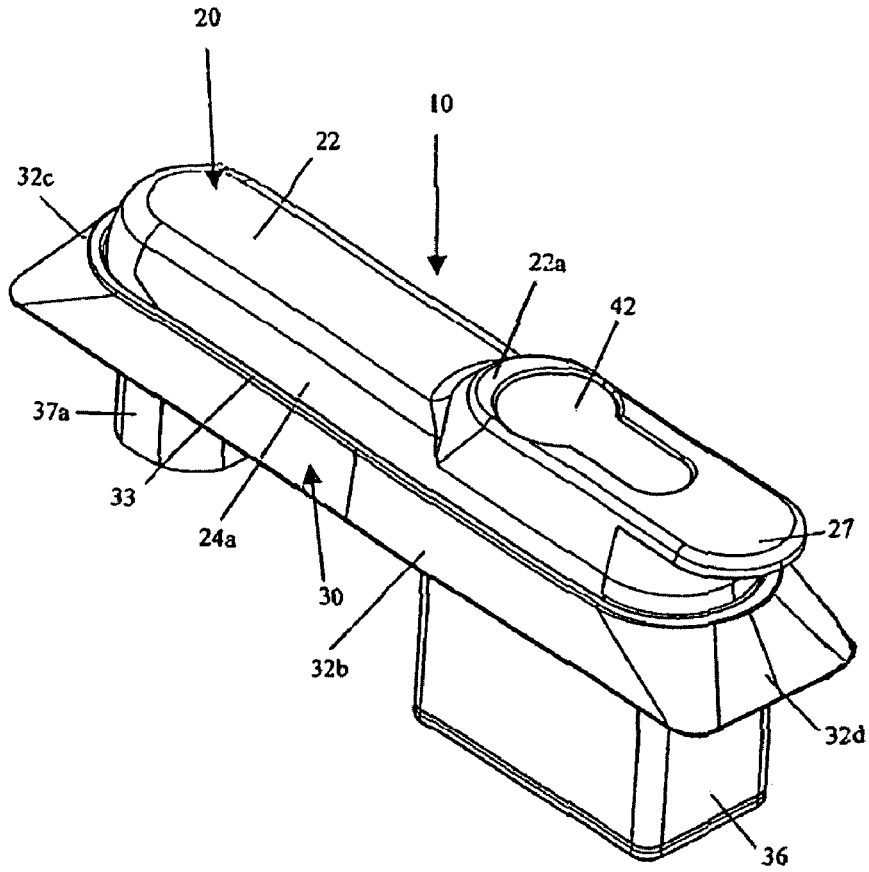
FIG. 1 is a perspective view of the swing handle assembly of the invention with the handle member in the closed position.
Figure 2:
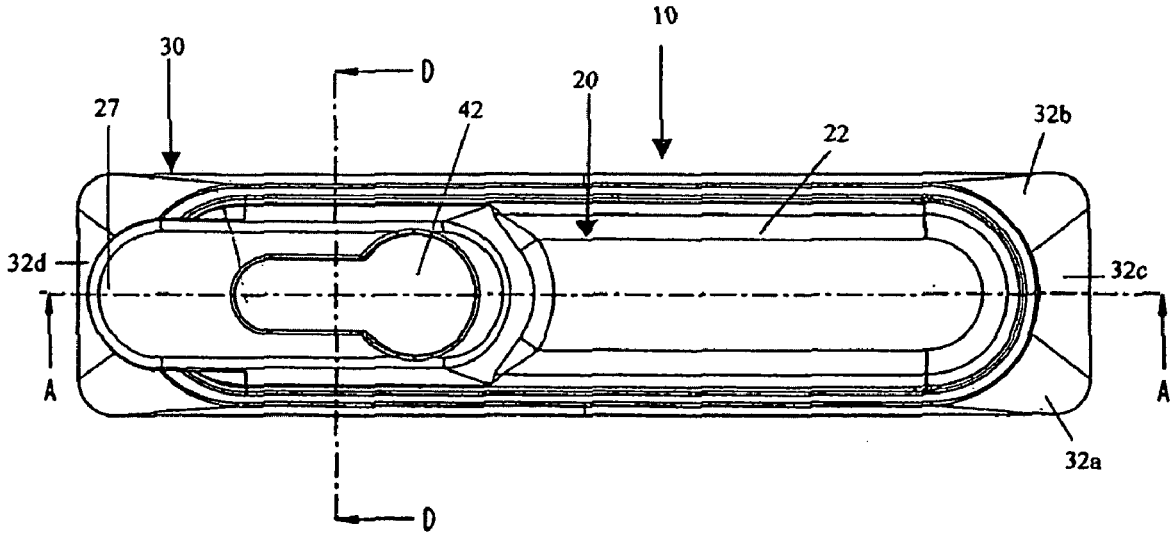
FIG. 2 is a plan view of a swing handle assembly.
Figure 3:
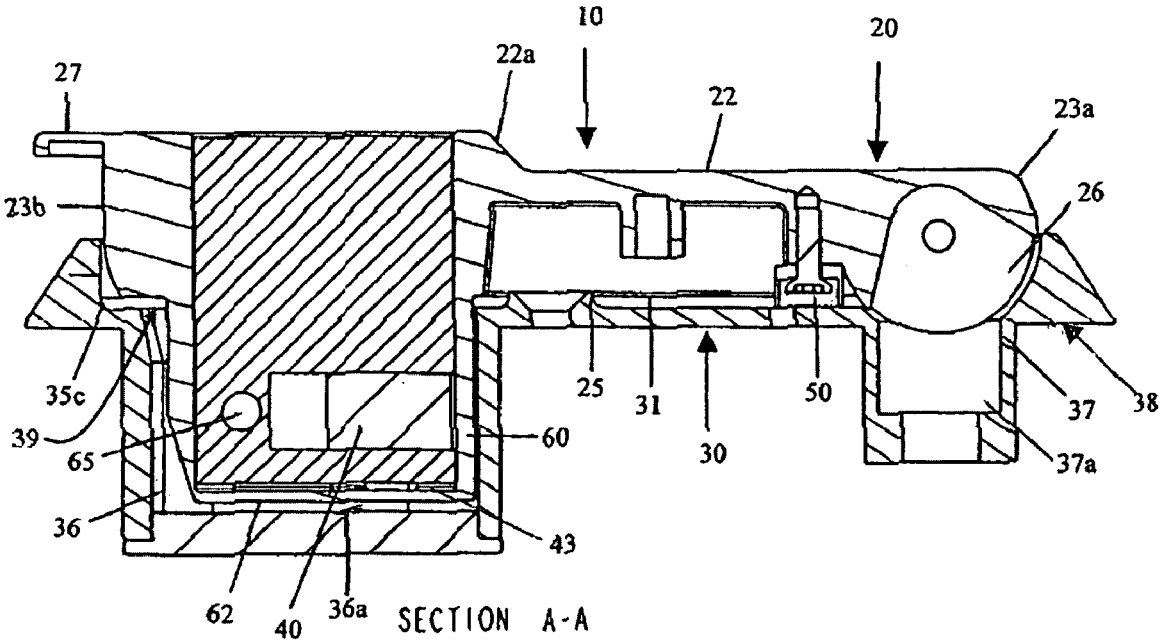
FIG. 3 is a sectional view through A-A of the swing handle assembly of FIG. 2.
Figure 4:
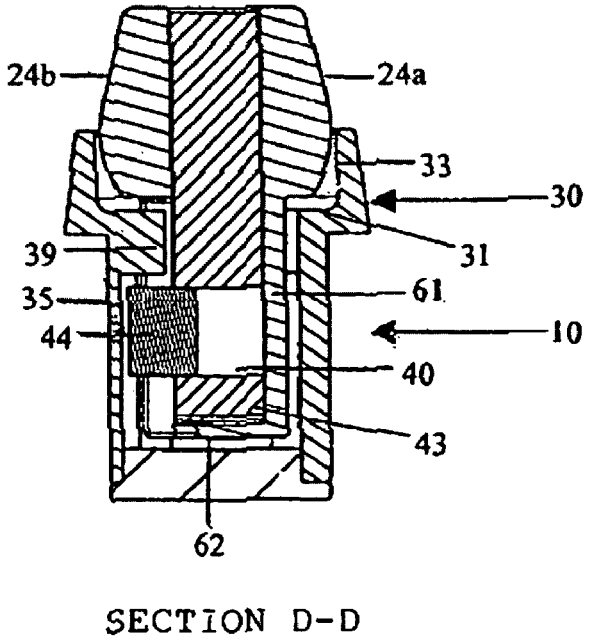
FIG. 4 is a sectional view through D-D of the swing handle assembly of FIG. 2.
Figure 5:
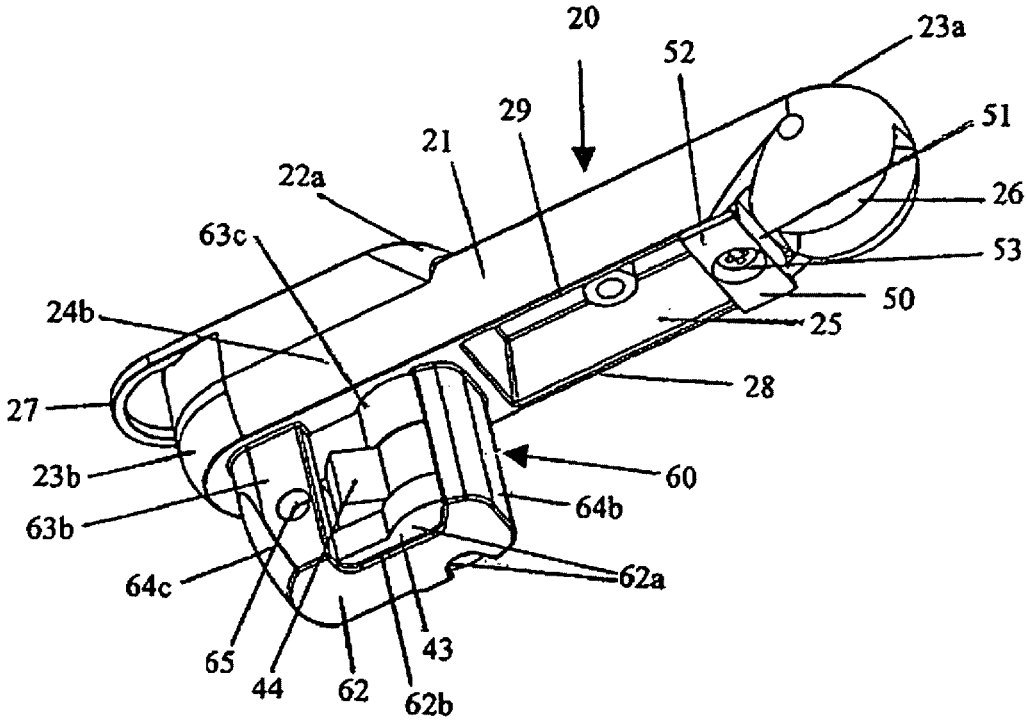
FIG. 5 is a perspective view from underneath the handle member of the swing handle assembly.
Figure 6:
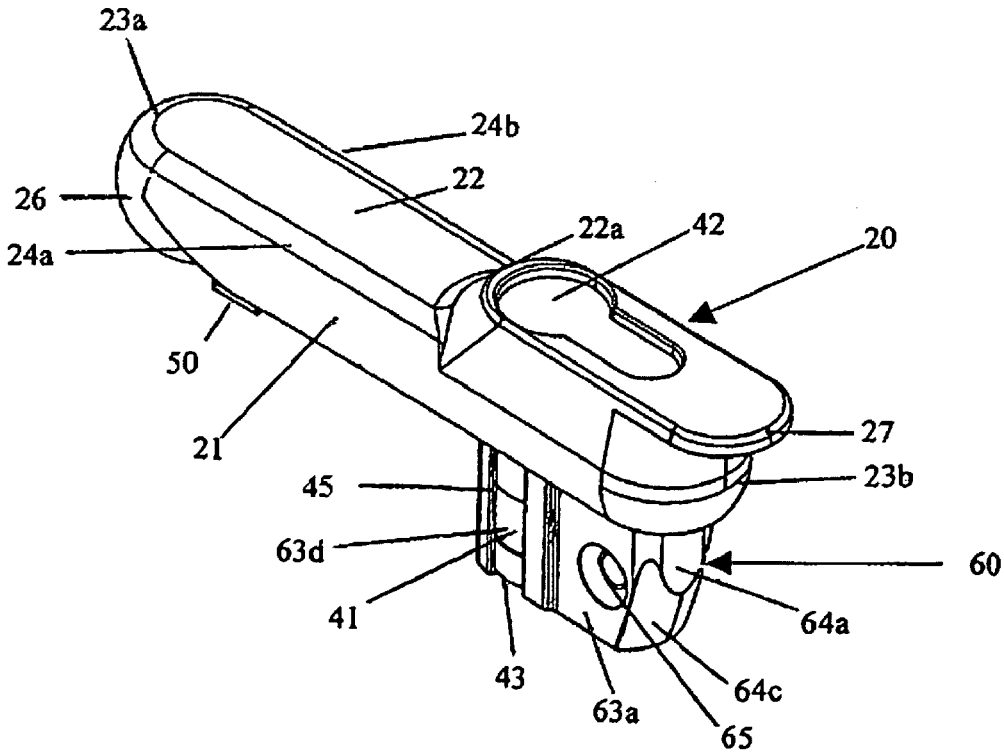
FIG. 6 is a perspective view of the top of the handle member of FIG. 5.
Figure 7:
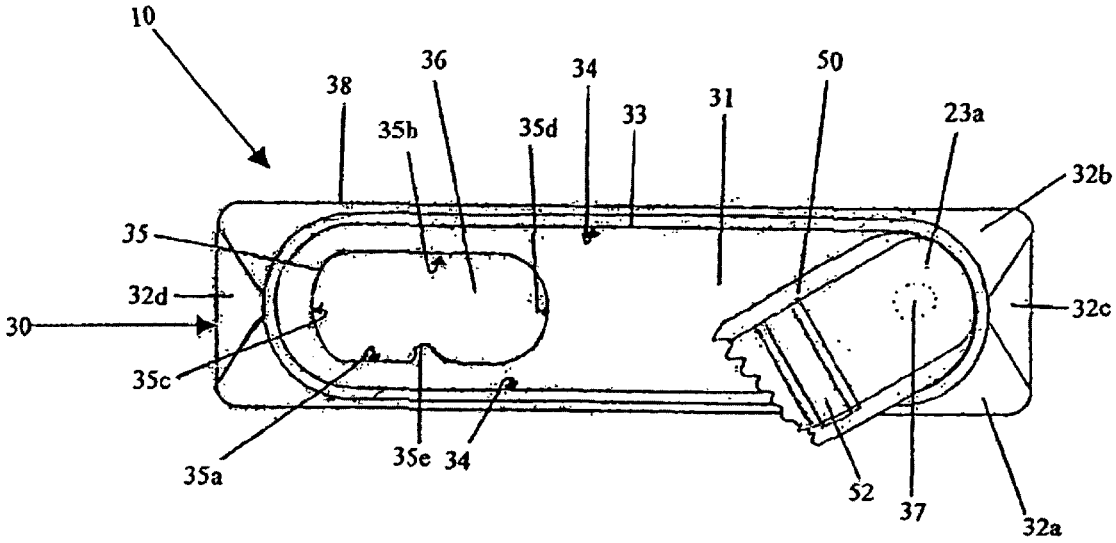
FIG. 7 is a plan view of the frame of the swing handle assembly with the handle member partly showing.
Figure 8:
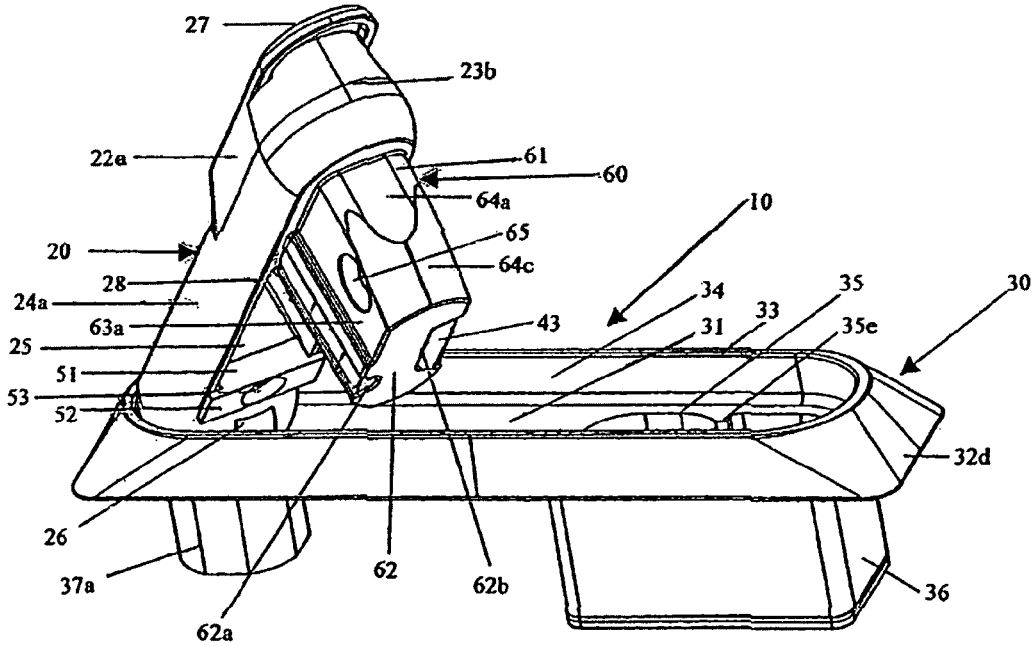
FIG. 8 is a perspective view of the swing handle assembly of the invention with the handle member in the open position.

Referring to all the drawings wherein like reference numerals designate like or corresponding parts throughout the several views, an assembled view of an embodiment of the handle assembly 10 is shown. The handle assembly 10 generally comprises a handle member 20, preferably in the general shape of an obround and a frame 30 of preferably a substantially rectangular configuration. In order to place the handle member 20 into locked engagement with the frame 30, there is preferably provided a locking means 40, preferably in the form of a barrel/cylinder lock means, supported by a housing 60, which is securable to or integral with the handle member 20. The combination of the handle member 20, the locking means 40 and the frame 30, to which the handle member 20 is locked, form a locking device that may be placed in a locked or unlocked condition. Where the handle member 20 is fitted to or upon a lock-actuating shaft 37*a*, the user thereof is able to place the locking shaft 37*a* and any attached or linked operator means (not shown) into a locked or unlocked condition. The frame 30 preferably is substantially rectangular in overall shape having a base section 31 and substantially oblique upwardly extending outer walls therefrom 32*a*, 32*b*, 32*c* and 32*d* which preferably terminate in and thereby provide a first substantially obround opening 33 into the interior of the frame 30. Preferably, the interior walls 34 of the frame 30 are substantially perpendicular to the base section 31.

The base section 31 preferably contains a second opening 35 therein, which opening 35 leads into a chamber 36. The second opening 35 is also preferably of a substantially obround configuration. The chamber 36 may be in the form of a chamber or well which may be of any suitable size and/or shape to suitably receive the housing 60 and/or co-operate with its associated locking means 40 when located or positioned within the chamber 36. The base section 31 also preferably contains a second opening/recess 37 to accommodate a lock-actuating shaft 37*a* to which an operator means, for example, a separate locking mechanism (not shown) positioned within a door may be attached.

The handle member 20 and its locking means 40 supported by the housing 60 are adapted to be able to substantially sit or be substantially accommodated within the correspondingly-shaped first opening 33 of the frame member 30. Thus, when the opening 33 of the frame member 30 is obround then it is preferred that the external perimeter of the handle member 20 is also obround to permit it to sit or be substantially accommodated within the frame 30.

Preferably, the handle member 20 is a substantially obround member having an open box-like body 21 comprising an upper wall 22, opposed end walls 23*a* and 23*b* extending therefrom, which are preferably of a semicircular configuration, opposed side walls 24*a* and 24*b* and an underside 25 that may be partially open. The underside preferably contains edges 28 and 29. The spacer means 50 (described below) is adapted to engage with or sit on or even within edges 28 and 29.

The handle member 20 has a housing 60 extending out from its underside 25. The housing 60 acts to support and/or hold and secure the locking means 40 when fitted to the handle member 20. Preferably, the housing 60 is of a general overall shape that enables it to pass through second opening 35 of the base section 31 and also to substantially lie within chamber 36, when the handle member 20 is located or sits within first opening 33 of the frame 30. Accordingly, the housing 60 is also a substantially obround member having a box-like body 61 comprising a lower wall 62, substantially upwardly extending side walls 63*a* and 63*b*, opposed end walls 64*a* and 64*b* extending therefrom, which are preferably of a substantially semi-circular configuration. The lower wall 62 may contain cut-out region(s) 62*a* and similarly one or both side walls 63*a* and 63*b* can be provided with cut-out portions 63*c* and 63*d*, respectively. The cut-out region(s) 62*a* and portions 63*c* and 63*d* act to expose part of the locking means 40 and preferably the lock actuator 44. The cut-out regions also permit access to the working parts of the locking means 40 which may require servicing. To side walls 63*a* and 63*b*, there is also preferably provided a securing means 65, preferably as a counter-sunk hole in wall 63*a*, which is adapted to receive a complimentary fitting means, such as a threaded screw or bolt, which when in position can act with aligned hole in wall 63*b* to releasably hold the locking means 40 in working contact with the housing 60 and thus the handle member 20. One of the opposed end walls 64*a* is preferably chamfered 64*c* relative to the other opposed end wall 64*b*. This chamfering ensures that the housing 60 does not strike or contact rounded edge 35*c* of second opening 35 of frame 30 when the housing 60 is lifted in and out of opening 35.

One of the end walls 23*a* of the handle member 20 or that end wall itself may be in the form of a ball joint 26 or the like and when the ball joint 26 co-operates with its complementary assembly such as the lock-actuating shaft 37*a*, which is securable to the base section 31 of the frame 30, the handle member 20 is pivotable about that ball joint 26-lock-actuating shaft link. The other end wall 23*b* preferably has a lifting means 27 integral thereto and which is also of a semicircular configuration. Preferably, through raising lifting means 27, when the handle member 20 is in an unlocked condition, the handle member 20 and its housing 60 are sufficiently also raised out of first opening 33 and are then able to pivot relative to the other end 23*a* of the handle member 20 namely the ball joint 26 which engages with the lock-actuating shaft 37*a*. When the handle member 20 is accommodated in the first opening 33 of the frame 30, preferably part of the lifting means 27, extends beyond the periphery of the opening 33, to permit and facilitate access to it for the user.

Preferably, the lifting means 27 is formed such that it is of reduced thickness relative to the thickness of the end wall 23*b* of the handle member 20 to which it is attached or forms part thereof. In this form, should the swing handle assembly be in a locked condition, and an intruder tries to lever the handle member 20 out of the frame 30 via the lifting means 27, the lifting means 27 will break or fracture in favour of the handle member 20 remaining in locked contact with the frame 30. Having broken or fractured the lifting means 27, it is now more difficult for the intruder to separate the handle member 20 from the frame 30.

When the handle member 20 and its associated housing 60 and locking means 40 are positioned in the first opening 33 of the frame 30, the underside 25 of the handle member 20 will preferably sit upon at least part of the exposed area of the base section 31 of the frame 30. The lower wall 62 of the housing 60 preferably comes into close contact with the bottom wall 36*a* of the chamber 36. That part of the locking means 40, namely a cylinder barrel 41, which protrudes from the underside 25 of the handle member 20 and preferably supported by housing 60 is preferably aligned with the second opening 35 in the base section 31, whereby at least part of the housing 60 supporting the locking means 40 is/are able to be accommodated within the chamber 36. When so positioned, the user of the device is then able to operate the locking means 40, which preferably co-operates with the chamber 36, to lock the locking means 40 and thus the associated handle member 20 into engagement with the frame 30, whereby the handle member 20 is now held in the frame 30 and is unable under normal use from being released from the frame 30 to permit the handle member 20 from being turned to open the assembly upon which the handle member 20 is located.

The actuating shaft 37*a* passing through the second opening 37 of the frame 30 is preferably retained in a tight but pivotable frictional engagement, by way of threadable nuts (not shown) positioned on the actuating shaft 37*a* on the underside 38 of the frame 30 to facilitate rotational movement of the handle member 20 about the shaft to the open position, when the handle assembly 10 is in the unlocked condition. The lock-actuating shaft 37*a* is retained in pivotal relationship with the ball joint 26 by a second securing means, for example, threadable nuts (not shown) on the underside 38 of the frame 30.

The handle member 20 preferably also comprises a substantially raised section 22*a* of upper face 22, where the raised section 22*a* extends towards and may terminate with the lifting end 27. This raised section 22*a* can provide protection to locking means 40 preferably of a cylinder/barrel lock 41 when received therein. The locking means 40 preferably comprises a key-receiving end 42 and a locking bolt end 43 comprising a lock actuator 44 for locking the handle member 20 to the frame 30 and thus the assembly 10 and thereby the door to which it is secured. The key-receiving end 42 of locking means 40 is preferably fitted with a lock cylinder 45 for locking the locking means 40, wherein a key inserted via key-receiving end 42 into the lock cylinder 45 is able to actuate the lock actuator 44 of the locking means 40. High security locking means are often of a larger size than conventional locking means and the raised section 22*a* of the upper face 22 of the handle member 20 offers increased protection by appropriately surrounding the key-receiving end 42 of the locking means 40. Lock actuator 44 is able to pass through cut-out portion 63*c* of housing 60 to allow engagement with a protrusion 35*e* in the side wall 35*a* of second opening 35 of the chamber 36. When the assembly 10 is in the locked condition, the handle member 20 is partially or totally received within the first opening 33 of frame 30 and it sits upon the base section 31 substantially parallel with the base section 31 of the frame 30. This improves not only the aesthetic appearance, but also the security of the handle assembly 10.

The generally obround-shaped second opening 35 of frame 30 includes a first side wall 35*a*, a second side wall 35*b*, and rounded end walls 35*c* and 35*d*. The first side wall 35*a* preferably contains a protrusion 35*e*, which is adapted to co-operate with the lock actuator 44 passing through the cut-out portion 63*c* in the housing 60. When the lock actuator 44 is retained under and by protrusion 35*e*, the locking means 40 and the handle member 20 to which it is secured is substantially prevented from being able to be lifted out of the frame 30 and thus pivoted, thereby also preventing any device coupled to the ball joint 26 from moving. In other words, the handle member 20, which directly or indirectly cooperates with a latching bolt (not shown) situated internally of the door, is prevented from being pivotally or rotatably moved from its closed position, when the lock cylinder 45 is in the locked condition.

In another form, the dimensions of the opening 35 may be less than the internal dimensions of the co-operating chamber 36 therebeneath, such that the opening 35 acts as a lip 39 or has inwardly directed edges relative to the chamber 36, whereby the lock actuator 44 is able to co-act with the lip 39 to hold the handle member 20 in a locked condition relative to the frame 30.

When the lock cylinder 45 is in the unlocked condition and the lock actuator 44 is no longer held behind protrusion 35*e* or under lip 39, the handle member 20 and its housing 60 using the lifting means 27 are able to be lifted up and by upward pivotal movement of handle member 20 relative to the ball joint 26 the cooperating lock-actuating shaft 37*a* can rotate or be moved relative to the frame 30. The latching bolt (not shown) in engagement with the lock-actuating shaft 37*a* is thereby moved from the locked to the unlocked condition to allow the door to be opened. When the lock cylinder 45 is in the unlocked condition, the handle member 20 can be received into the opening 33 with its housing 60 and its locking means 40 being received within the chamber 36. When and if required, a suitable key inserted into the key-receiving means 42 of the locking means 40 engages with lock cylinder 45 and can then be turned to lock the actuator 44 behind the protrusion 35*e* or lip 39 and thus prevent the lifting of the handle member 20 from out of the frame 30.

To the handle member 20, a spacer means 50 can be attached. Preferably, the spacer means 50 is formed separately of mouldable plastic and is attachable to the underside 25 of the handle member 20. When the spacer means 50 is an add-on element to the handle member 20, it can be mounted onto, preferably by screw fitting thereto, the underside region 25 of the handle member 20. Alternatively, the spacer means 50 may be manufactured such that it is integrally formed with the handle member 20. Preferably, the spacer means 50 is of a substantially T-shaped configuration having a stem and cross-piece. In its simplest form, the spacer means can be a substantially square or rectangular member provided that when in use it is able to engage with or sit on the handle member in such a way that when the spacer means member 60 in contact with one of the edges of the frame 30, it holds the handle member 20 and housing 60 out of contact with the surface area surrounding the handle assembly.

In the embodiment shown, the stem piece 51 is able to be retained within or on the underside region 25 of the handle member 20. The cross-piece 52 of the spacer means 50 is able to engage with or sit on edges 28 and 29 of the opening 25 of the handle member 20. A passageway 53 is preferably provided in the upper surface of cross-piece 52 and also extends through the stem piece 51. Through this passageway, a detachable fastener, such as a screw or the like, can pass to fasten the spacer means 50 to the handle member 20.

The cross-piece 52 is preferably of a substantially rectangular shape and its edges preferably align with edges 28 and 29 of the handle member 20 to enable the handle member when fitted with a spacer means 50 to be able to fit or sit within opening 33 of the frame 30.

The spacer means 50 is locatable on the handle member 20 substantially proximate to the ball joint region 26, such that when the handle member 20 is in the unlocked condition and the handle member 20 is lifted out of the opening 33 of the frame 30, the spacer means 50 via its cross-piece area 52 contacts one of the oblique side wall edges 32*a* or 32*b* of the frame 30, and is able to retain handle member 20 out of alignment for closing with the frame 30. In addition, the spacer means 50 is able to hold the housing 60 supporting the locking means 40 protruding from the underside 25 of the handle member 20 from contacting the surface of the door, etc to which the handle assembly 10 is fixed. Thus, handle member 20 is thereby caused to sit in a raised position above and rest upon the at least one side wall edge 32*a* or 32*b* of the frame 30. In this way, the handle member 20 and housing 60 are substantially prevented from crashing into and thus potentially damaging the area surrounding the handle assembly 10 if the handle member 20 is accidentally dropped.

Device Assembly

To assemble the first embodiment of the handle assembly 10, handle member 20 via its ball joint 26 is attached to lock-actuating shaft 37*a*, which shaft has been fed through second opening 37 in base section 31 of frame 30. Fastening means, preferably nuts, (not shown) positioned on lock-actuating shaft 37*a* distal from the ball joint connection are then tightened toward the underside 38 of the frame 30 to enable pivotal movement of the handle member 20 relative to the frame 30. The key-receiving means 42 of locking means 40 is received within the raised section 22*a* of the upper face 22 of handle member 20 such that end 42 is flush-fitted relative to the raised section 22*a*. The locking cylinder 45, being substantially enclosed within its housing 60, both protrude from beneath the underside 25 of the handle member 20. Handle member 20 and its housing 60 and locking means 40 are then positioned above opening 33 of the frame 30 and by lowering the handle member 20 into the first opening 33, the housing 60 and its locking means 40 aligned with the second opening 35 in the base section 31 are able to be received therethrough. The locking cylinder 45 together with housing 60 can now lie within chamber 36, while the underside 25 of the handle member 20 sits upon the base section 31. Through the turning of a matching key having been placed in the key-receiving end 42 of the locking means 40, the lock actuator 44 of locking means 40 rotates and is caused to align under protrusion 35*e* or lip 39. In this state, the protrusion 35*e* or lip 39 and lock actuator 44 located thereunder restrict the lifting of the handle member 20 out of the frame 30. The key can then be removed from the locked assembly.

The reintroduction of the key and its counter rotation causes the lock actuator 44 to disengage from the protrusion 35*e* or lip 39 and the assembly is now unlocked. In this state, by raising lifting means 27, the handle member 20 and housing 60 are able to be pivotally raised above the frame 30 about the ball joint 26. By moving the raised end of the handle member 20 laterally relative to the attached frame 30, the spacer means 50 is positioned such that should the handle member 20 be accidentally dropped, the spacer means 50 causes the handle member 20 to rest upon the side walls of the frame 30 thus preventing the housing 60 and locking means 40, protruding from the handle member 20, from contacting the surface area surrounding the frame 30. In this way, the spacer means 50 substantially prevents the handle member 20 and housing 60 from damaging the surrounding area.

Use of Device

In use, the handle assembly 10 is positioned within a door cavity or on the outer face of the door. To the lock-actuating shaft 37*a*, which protrudes from the underside of the frame 30 to the area inside the secure environment, one may add a suitable locking bolt and handle means, such that the handle assembly 10 is also operable from the interior of the secured enclosure.

When the handle member 20 is unlocked and lifted from out of the frame 30 and then pivoted to either the left or the right and brought down to rest on the side wall 32*a* or 32*b* of the frame 30, the spacer means 50 on the underside of the handle member 20 rather than the handle member itself coming into direct contact with the frame 30, raises the handle member 20 above the area surrounding the handle assembly 10, thereby preventing scratching and damage to the vehicle or cabinet in which the handle assembly is installed.

It has been found that the provision of the housing 60 not only offers support for and correct alignment of the locking means 40 relative to the opening 35 in the base section 31 of the frame 30, but it also provides added protection to the handle assembly 10. Should an intruder attempt to break open the handle assembly 10 by trying to smash the assembly, the housing 60 acts to hold the locking means 40 in place relative to the handle member 20. Should however the intruder succeed in fracturing the housing 60, the resulting debris from the broken or shattered housing 60 made up of the lower wall, opposed end walls and/or side walls can fill the available space surrounding the lock actuator 44, such that the actuator 44 is unable to rotate and thus remains in locked contact with the frame 30. The raised section 22*a* on the upper and exposed face 22 of the handle member 20 acts to surround and therefore protect the key-receiving means 42 in the event of an intruder attack.

Throughout this specification, unless the context requires otherwise, the word "comprise", or variations such as "comprises" or "comprising" will be understood to imply the inclusion of a stated integer or group of integers, but not to the exclusion of any other integer or group of integers.

As the present invention may be embodied in several forms without departing from the spirit of the essential characteristics of the invention, it should be understood that the above-described embodiments are not to limit the present invention unless otherwise specified, but rather should be construed broadly within the spirit and scope of the invention. Therefore, the specific embodiments are to be understood to be illustrative of the many ways in which the principles of the present invention may be practiced.

The claims defining the invention are as follows:

1. A swing handle assembly comprising a lockable handle member including a pivotally attached end and an end distal from the pivotally attached end comprising a substantially deformable housing and a locking means wherein the substantially deformable housing is adapted to at least partially support the locking means and wherein the locking means is located in the substantially deformable housing, and a frame coupled to the lockable handle member at the pivotally attached end and adapted to couple with the substantially deformable housing of the lockable handle member, wherein the swing handle assembly can be placed in a locked condition by pivotally swinging into cooperable alignment the lockable handle member with the frame and locking the locking means thereto and wherein the locked condition of the assembly can be maintained by the substantially deformable housing in response to destructive outside forces causing deformation thereof, which prevents the swing handle assembly from moving to an unlocked condition.

2. A swing handle assembly according to claim 1, wherein the frame is a substantially open-box member comprising a substantially rectangular-shaped base section having substantially oblique-shaped upwardly extending outer walls, wherein the outer walls terminate in a first opening which provides an entry to the interior of the frame.

3. A swing handle assembly according to claim 2, wherein the base section contains a second opening therein leading to a chamber or well which is either formed substantially integral with the base section or is locatable under and aligned with the second opening, wherein the chamber is adapted to substantially receive the housing.

4. A swing handle assembly according to claim 3, wherein the handle member is of a substantially complementary shape to the first opening of the frame to allow the handle member to be able to substantially sit or be substantially accommodated within the first opening.

5. A swing handle assembly according to claim 4, wherein the handle member is of an open box-like body configuration.

6. A swing handle assembly according to claim 5, wherein the handle member is of a substantially obround shape comprising an upper wall having opposed end walls extending therefrom, opposed side walls and a partially open underside wherein the underside contains edges on or even within which a spacer means is adapted to engage.

7. A swing handle assembly according to claim 6, wherein the handle member and its housing are substantially receivable in the first opening of the frame, the housing also being substantially receivable within the second opening of the frame, wherein the locking means enables lockable operation of the handle member relative to the frame by placing the locking means substantially supported by the housing in the locked condition.

8. A swing handle assembly according to claim 7, wherein the locking means is of a barrel type comprising a cylinder or barrel with a locking bolt end and a key arrangement with a key-receiving end, wherein the locking bolt end contains a lock actuator to engage the frame for locking the handle member to the frame, thereby placing the assembly in a locked condition.

9. A swing handle assembly according to claim 8, wherein the key-receiving end of the locking means is substantially flush-mounted with an upper face of the handle member.

10. A swing handle assembly according to claim 9, wherein the housing is a substantially obround member having a box-like body comprising a lower wall having substantially upwardly side walls and opposed end walls extending therefrom, which end walls are of a substantially semi-circular configuration, wherein the lower wall, or at least one of the side walls is provided with a cut-out region which acts to expose the lock actuator to enable the lock actuator to move between a locked and an unlocked position.

11. A swing handle assembly according to claim 10, wherein one of the opposed end walls is chamfered relative to the other opposed end wall to facilitate receipt or removal of the housing relative to the second opening of the frame.

12. A swing handle assembly according to claim 11, wherein when the locking means is supported in the housing and is subjected to a destructive outside force, the force causes the locking means to deform, substantially fracture, or deform and substantially fracture the lower wall of the housing such that resultant pieces of the lower wall act to substantially prevent the assembly from being placed in the unlocked condition.

13. A swing handle assembly according to claim 1, further comprising a spacer means to hold the handle member above or out of contact with an area surrounding the assembly.

14. A swing handle assembly according to claim 13, wherein the spacer means is of a substantially T-shaped configuration having a stem and a cross-piece, wherein the stem piece is able to be substantially retained within the handle member, while the cross-piece is able to substantially engage with or sit on the underside region of the handle member.

* * * * *